US006871606B2

(12) United States Patent
Schweizer

(10) Patent No.: US 6,871,606 B2
(45) Date of Patent: Mar. 29, 2005

(54) METHOD AND DEVICE FOR REGULATING MATERIAL TRANSPORT IN A SEWING OR EMBROIDERY MACHINE

(75) Inventor: Manfred Schweizer, Steckborn (CH)

(73) Assignee: Fritz Gegauf Aktiengesellschaft BERNINA-Nahmaschinenfabrik, Steckborn (CH)

( * ) Notice: Subject to any disclaimer, the term of this patent is extended or adjusted under 35 U.S.C. 154(b) by 73 days.

(21) Appl. No.: 10/325,775

(22) Filed: Dec. 19, 2002

(65) Prior Publication Data

US 2003/0131773 A1 Jul. 17, 2003

(30) Foreign Application Priority Data

Dec. 19, 2001 (CH) ..... 2001 2317/01

(51) Int. Cl.[7] ..... D05B 1/00

(52) U.S. Cl. ..... 112/475.02; 112/102.5; 112/315

(58) Field of Search ..... 112/102.5, 470.03, 112/470.06, 314, 475.02, 475.04, 475.05

(56) References Cited

U.S. PATENT DOCUMENTS

| | | | | | |
|---|---|---|---|---|---|
| 4,539,925 | A | * | 9/1985 | Shim | 112/314 |
| 4,658,741 | A | | 4/1987 | Jehle et al. | |
| 4,706,584 | A | * | 11/1987 | Senda et al. | 112/470.03 |
| 4,742,789 | A | * | 5/1988 | Pestel et al. | 112/475.05 |
| 4,901,660 | A | * | 2/1990 | Takeuchi et al. | 112/470.03 |
| 6,718,893 | B1 | * | 4/2004 | Kong | 112/102.5 |

* cited by examiner

*Primary Examiner*—Peter Nerbun
(74) *Attorney, Agent, or Firm*—Volpe and Koenig, P.C.

(57) ABSTRACT

A method and device for regulating the transport of material in a sewing or embroidery machine (1) that uses information from a position or movement sensor (33) located underneath the throat plate (21). The controls for the sewing machine (1) calculate deviations of the actual feeding increments of the article to be sewn from the corresponding target values from the periodically read sensor signals. With this information, the feeding increments are regulated in such a way that the deviations are cancelled out by averaging.

12 Claims, 9 Drawing Sheets

METHOD AND DEVICE FOR REGULATING MATERIAL TRANSPORT IN A SEWING OR EMBROIDERY MACHINE

BACKGROUND

The invention is directed to providing a method for regulating material transport in a sewing or embroidery, as well as a device for implementing the method.

In sewing and embroidery machines, the article or material to be sewn is transported in each case after the execution of a sewing stitch by a material transport device. Such material transport devices are, for example, material feeders located underneath a throat plate or movable embroidery frame.

Material feeders can feature one or more bars lying horizontally, which are sawtooth shaped on the side facing the article to be sewn. Following the execution of each sewing stitch, i.e. after the sewing needle is no longer in contact with the article to be sewn, the material feeder performs one or more cyclical movements, whereby the article is transported one or more increments further in the direction of sewing. The material feeder is thereby raised so far that the bars protrude through slot shaped openings in the stitching plate and come into contact with the article to be sewn. The article to be sewn is pressed against the stitching plate and/or against the bars reaching through the throat plate by a presser foot. The material feeder then executes a pushing movement in the direction of sewing, whereby the article to be sewn is transported one increment in the direction of sewing. After this, the material feeder is lowered again, so that the bars no longer protrude above the throat plate and return to their original position. The individual partial movements can be merged into a continuous motion sequence. In most sewing machines, the direction of sewing can be reversed by reversing the described motion sequence, so that the new direction of sewing runs in the opposite direction of the original direction of sewing. There are also sewing machine models in which the material feeder, in addition to the direction of sewing, and in an analogous manner, can also execute transport movements that are perpendicular to the direction of sewing, so that the material or the article to be sewn can be moved in two dimensions or in a sewing plane predefined by the upper surface of the throat plate. Sewing machines of this type can be used for the embroidery of small patterns. Alternatively, an embroidery frame can also be used for the embroidery of patterns. Instead of material feeders, for example, an embroidery frame which can be driven by two stepper motors is used for moving the article within the sewing plane, whereby the material or the article is clamped into this embroidery frame.

Following the execution of a sewing stitch, the embroidery frame is moved via both stepper motors in such a way that the new stitching site is positioned underneath the sewing needle. For certain sewing procedures, and especially for the embroidery of patterns, it is of great importance that predetermined stitch lengths and directions within the sewing plane be observed. In conventional sewing and embroidery machines, the actual stitch lengths and directions can deviate, however, from the values set on the machine or calculated by the machine's control system. The actual material feeding in one or two directions during the individual transport steps or cycles does not correspond to the required specified values. Such deviations may be either system-contingent or random. Deviations of the actual stitch lengths or feeding increments from the respective target stitch lengths or target feeding increments of the material transport device may depend, for example, on the sewing machine model, or on the characteristics of the article or the material, or on the force effects on the article to be sewn when sewing or embroidering. Of particular importance is the sewing material-dependent slippage during the transport procedure or different transport characteristics of forwards and backwards transport of the material. Deviations of the actual values from the target values can also occur when using embroidery frames, for example, when the material buckles within the embroidery frame.

With deviations in the actual stitch lengths and/or the actual feeding increments from the target stitch lengths and/or target feeding increments, incorrect seam lengths or undesired misalignment of embroidery patterns can occur. It is not possible for conventional sewing machines to return the article to its original position by forwards and'subsequent backwards transport with an equal number of each of a certain number of transport cycles. The same also applies to two-dimensional movement in the sewing plane. Incorrect seam lengths or cumulative misalignments of embroidery patterns can be the result.

A sewing machine with a device for measuring and regulating the size of the feeding increment is known from DE-C2-3525028. In the third embodiment, two CCD sensors situated opposite each other and vertically to the direction of sewing, with each being a line scan camera equipped with a light source. The line scan camera located to the front of the direction of sewing is switched on at the start of the sewing procedure and generates a digitalized real time line scan of a segment of the surface of the article. As soon as this segment of the surface is supposed to lie over the line scan camera situated to the rear in the direction of sewing according to the feeding speed, this line scan camera is switched on and scans the surface of the article until the pattern correlates with the pattern recorded beforehand by the forward line scan camera. A disadvantage of this device consists of its sensitivity to displacements which are perpendicular to the direction of sewing and to distortions of the article being sewn within the sewing plane. Even the smallest alterations in the position of the article to be sewn can lead to large differences in the calculation of correlation values. Furthermore, the brightness of the light source must be adjusted to the background brightness of the material. Also, the material to be sewn must at least be pushed forward the amount of the distance between both of the line sensors, until a value for the deviation of the actual feeding speed of the material from the target feeding speed can be determined. The measuring and regulation device can comprehend such deviations only in the direction of the feeding. In addition, the actual feeding speed must be slower than the target feeding speed. Both the calculation of the feeding speed and the position of the article to be sewn are afflicted with measurement errors.

SUMMARY

It is the object of the present invention to create a method and a device to quickly and accurately calculated and compensated for deviations of the actual feeding increments from the target feeding increments.

This object is accomplished by a method and a device for regulating the transport of material in a sewing or embroidery machine in accordance with the invention.

With the method and device according to the invention, target values for feeding increments for a material to be sewn can be detected for each sewing step or each feeding cycle. If the sensor for detecting the feeding increments features a sufficiently high scanning rate, then actual values for the feeding movement and/or the pushing forward of the article to be sewn can also result during pushing forward, thus during the execution of the sewing stitches or feeding cycles. By regulating the size of the feeding increment, the actual increments for the article to be sewn can be adjusted in such a way to the predetermined values of the target increments, that the average over one or more feeding cycles of the accumulated value of the actual increments coincides with the accumulated value of the target increments. Depending on need, the regulation of the size of the feeding increment can take place either quickly and with sensitivity or slowly.

In the first case, established deviations of the actual feeding from the target feeding increments in the execution of a sewing step or feeding cycle can already be compensated for in the same or in the immediately following sewing step or feeding cycle. The compensation in the following sewing step causes a relatively large difference in two adjacent increments. If the sensor utilized for detecting the feed rate features a significantly higher scanning rate than the time required for the execution of the sewing step, then the regulation of the size of the feeding increment can even take place during the execution of this sewing step. The actual values coincide in this case with the target values in the context of the accuracy of the regulation for each sewing step. This variant of the regulation of the size of the feeding increment is particularly important for material transport systems in which the drive is independent of the main drive of the needle bar. In the second case, the compensation for the detected deviation is executed in a divided manner over several sewing steps or feeding cycles, whereby, on the average, only small differences between the individual stitch increments result.

The method can be used for regulating the size of the feeding increment in forward and/or backward movements of the article to be sewn in one or two dimensions of the sewing plane.

In a preferred embodiment of the invention, deviations in the actual feeding of the material in the direction of sewing and in a cross direction perpendicular to the sewing direction can be detected by the sensor. When sewing in the direction of sewing, deviations in the sewing direction and/or in the cross direction detected by the sensor can be compensated for by influencing the size of the feeding increments in the direction of sewing and/or cross direction. The same applies to sewing operations in the cross direction.

The method and device in accordance with the invention are suited to the regulation of cyclically working feeding devices linked with the main drive of the needle bar. The method and the device can also be utilized for regulating the transport of material in the direction of sewing and/or cross direction with independent drives which are not linked to the main drive. Such drives can be, for example, the stepper motors of an embroidery frame or electric motor roller actuator.

BRIEF DESCRIPTION OF THE DRAWINGS

The invention is described in more detail below based on the attached drawings of a preferred embodiment. In the drawings.

DETAILED DESCRIPTION OF THE PREFERRED EMBODIMENT

Figure 1:
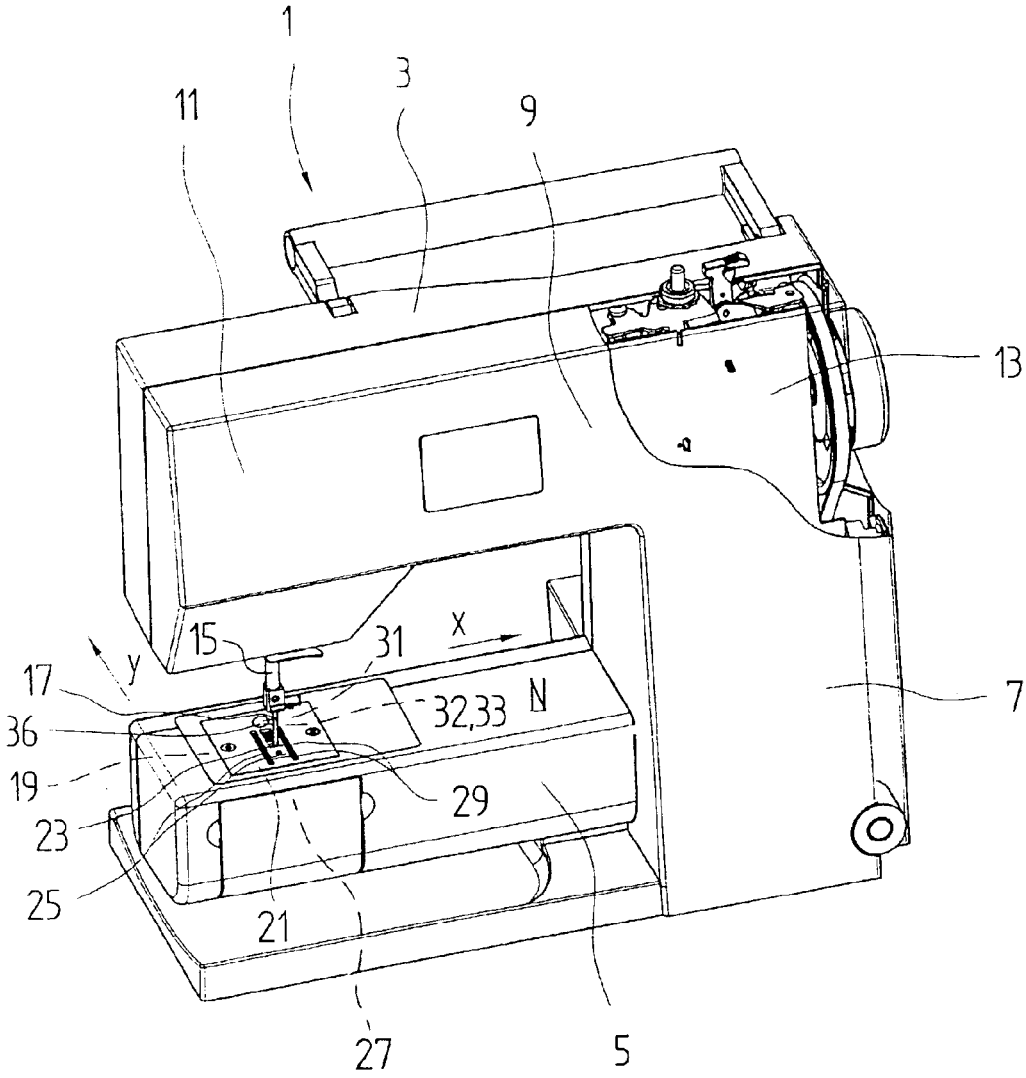
FIG. 1 is a foreshortened view of a sewing machine with the housing partially cut away and with an image sensor built into the throat plate.
Figure 3:
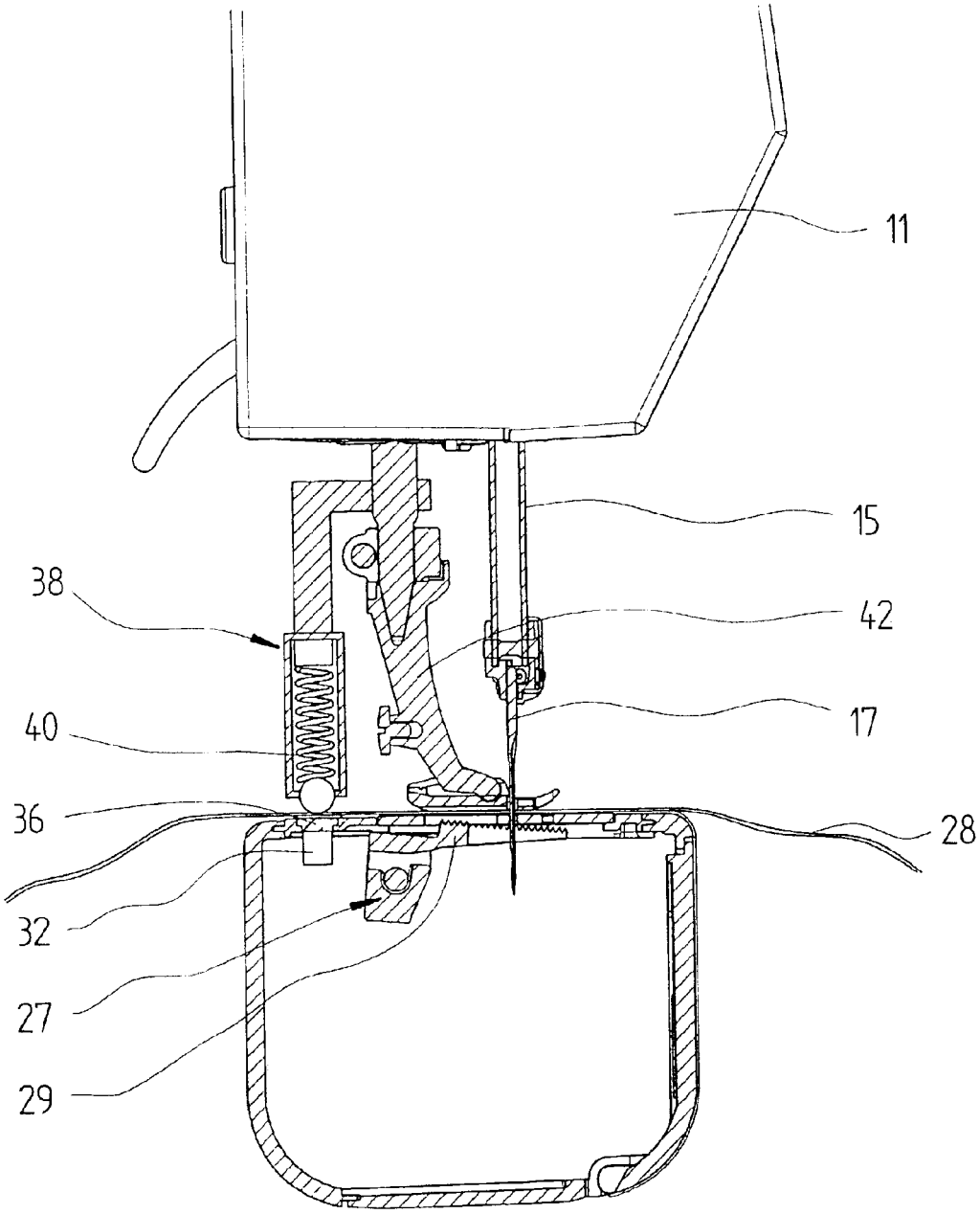
FIG. 3 is a cross sectional view through the lower arm and through a roller fastened to the presser foot which presses the article to be sewn onto a protective window.
Figure 4:
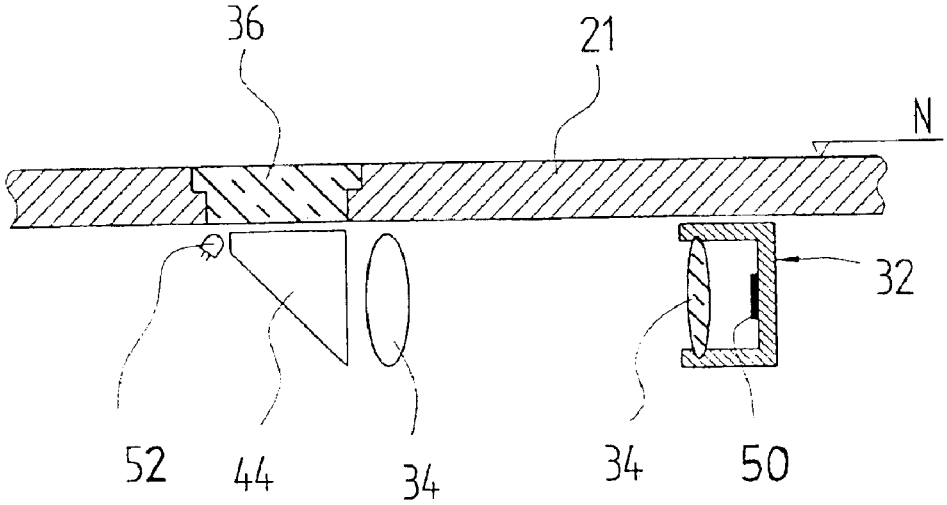
FIG. 4 is a cross sectional view of the throat plate with the fixing device for the sensor located underneath.
Figure 5:
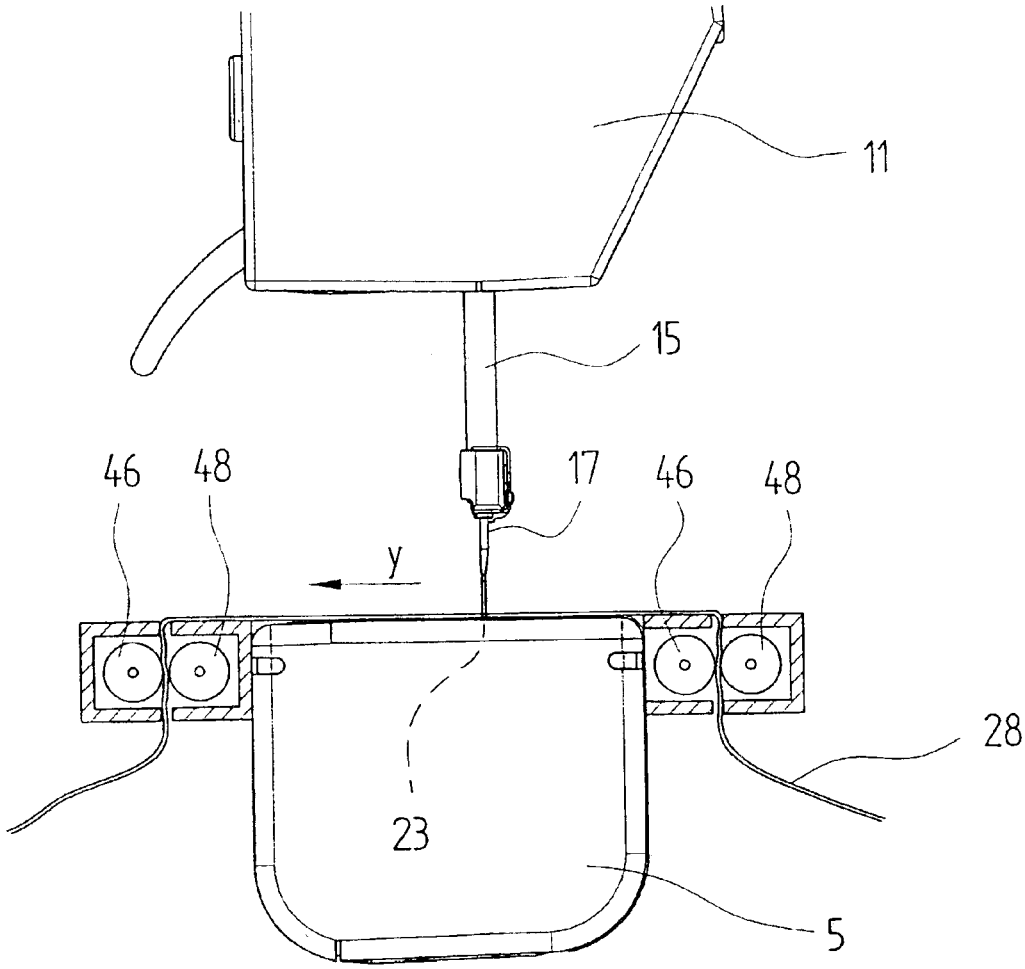
FIG. 5 is a side view of a part of the sewing machine in the cross direction with a cross section of two pairs of rollers for the transport of the sewing material in the direction of sewing.

FIG. 1 shows a preferred embodiment of a household sewing machine in accordance with the invention, referred to hereinafter as sewing machine 1 for short, with a machine housing, hereinafter the housing 3, which includes a lower arm 5, a machine arm 7 and an upper arm 9 with a machine head 11. The housing 3 is partially cut away in FIG. 1, so that a machine controller or controls 13 can be partially seen on the inside. A needle bar 15, which can be operated by a drive for the lifting and moving of a sewing needle (not illustrated in FIG. 1) also called needle 17, protrudes downwards out of the machine head 11. Underneath the machine head 11 is an opening or a well 19 on the upper side of the lower arm 5 covered by a throat plate 21. The upper side of the throat plate 21 and of the lower arm 5 are arranged flush with each other and define a sewing plane N that lies approximately perpendicular to the needle bar 15. The throat plate 21 has a slot-shaped needle opening 23 located under the needle bar. On each side of this needle opening is an oblong, approximately rectangular material feeder opening 25 in the throat plate 21. The three openings are not connected and together have the approximate shape of the capital letter "H". The two material feeder openings 25 are arranged with their longitudinal dimension running permanently in a sewing direction y. The longitudinal dimension of the needle opening 23 extends in a cross direction x lying vertical to the sewing direction y. A material transport device 27 for the incremental transport of material or an article to be sewn 28 (FIG. 7), located at least partially in the well 19, is comprised of two bar-like material feeders 29 in the area of the material feeder openings 25 which are sawtoothed or roughened on their upper side. Also, in the sewing direction y, immediately behind the needle opening 23, there is a round sensor opening 31 embedded in the throat plate 21. Of course, the sensor opening 31 could also lie before or beside the needle opening 23; however, it should be located in the area surrounding the needle opening 23, so that it lies in the immediate sphere of action of the material transport device 27. This means that the material feeder operated by the material transport device 27 can be recognized by a sensor 32 located in or underneath the sensor opening 31 without significant errors. Of course, several sensors 32 can also be utilized independently of each other or in combination with each other for this purpose. The sensor opening 31 can be round or it can have any other form, such as rectangular or oval. It can also be comprised of several divided openings, such as slot openings located parallel to each other. The sensor(s) 32 are designed for detecting a measurement category in at least one spatial dimension. The measurement category is preferably an optical pattern or the optical structure of the article to be sewn 28. A sensor 32 can be constructed in the form of a position sensor 33, for example, or arranged as a CCD row parallel to the sewing direction (y), or as a CCD matrix (50), or as a micro-camera with a lens 34 (FIG. 2) and with an image processing unit for detecting and processing a one or two dimensional image area. Of course, other location detecting sensors 32 can be used which use, for example, ultrasound, radar waves or other methods for detecting the position, location or speed of the article to be sewn 28. The position sensor 33 is positioned in the well 19 in such a way that a protective window 36 (FIG. 2) mounted in front of the lens 34 closes off the sensor opening 31 flush with the surface. As an option, the article to be sewn 28 can be pressed by a shoe or roller 38 (FIG. 3) in the area of the protective window 36 from the side of the machine head 11 against the throat plate 21 and/or the protective window. The shoe or roller 38, which can be pressed with the light pressure of a spring 40 on the article to be sewn 28, can, for example, be fastened to a support bar of a presser foot. In this embodiment, it can be brought into contact with the article to be sewn 28, together with the presser foot 42, for the sewing process, and then be lifted up again. The shoe or roller 38 ensures that the lifting movements of the material feeder 29 do not cause any errors in the detection of the forward motion values by the sensor 32. As an alternative to the position sensor 33, other sensors 33 operating on the basis of other technologies and/or several sensors 32 can also be utilized in the sensor opening 31, such as movement sensors or speed sensors. In the place of a sensor 32, a suitable means of transfer or connection for transferring the measurement category/categories to be detected to the sensors 32 in the sensor opening 31 on the throat plate 21 can be used, such as a bundle of optic fibers, an optimized lens system and/or an arrangement of mirrors and/or prisms 44 (FIG. 4). For transporting the article to be sewn 28 in the sewing direction y, a pair of rollers with at least a first roller 46 that is electrically driven (FIG. 5) and a second roller 48 that can be pressed against the first one can also be used as an alternative to the material feeder 29, whereby the article to be sewn 28 is fed through the rollers 46, 48. The surface of the rollers 46, 48 is made of a material such as rubber or another material which features good holding characteristics with regard to textiles. The pair of rollers can be situated behind or in front of the needle opening 23 in the sewing direction y. Alternatively, there can be a pair of rollers located both in front of and behind the needle opening 23. The advantage of such a roller drive lies in its independence from the main drive for the needle bar 15 and in the possibility of accommodating material feeding increments of any size in the direction of sewing y and opposite to the direction of sewing y.

Figure 6:
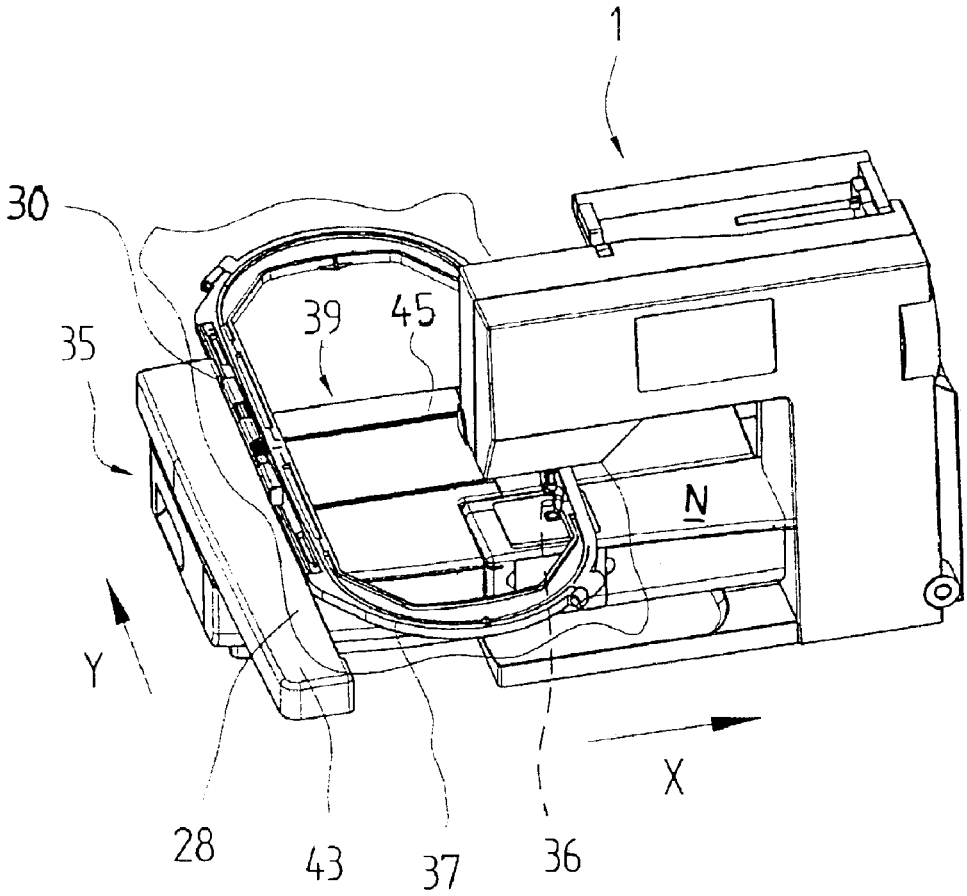
FIG. 6 is a perspective view of the sewing machine shown in FIG. 1 with a built-on embroidery frame.

In FIG. 6, the sewing machine 1 from FIG. 1 is shown with a built on embroidery module 35. The embroidery module 35 is comprised of an embroidery frame 37 for stretching and gripping the article to be sewn 28 and a positioning or movement device 39 driven by one of two (not portrayed) stepper motors for moving the embroidery frame 37 in or in opposition to the two directions x and y of the sewing plane N. The embroidery frame 37 is fastened to a frame holder 30, which can be moved along a first arm 43 of the movement device 39 in the y direction. This first arm 43 can in turn be moved along a second arm 45 of the movement device 39 in the x direction. The article to be sewn 28 is clamped into the embroidery frame 37 in such a way that it lies on the sewing plane N.

Figure 2:
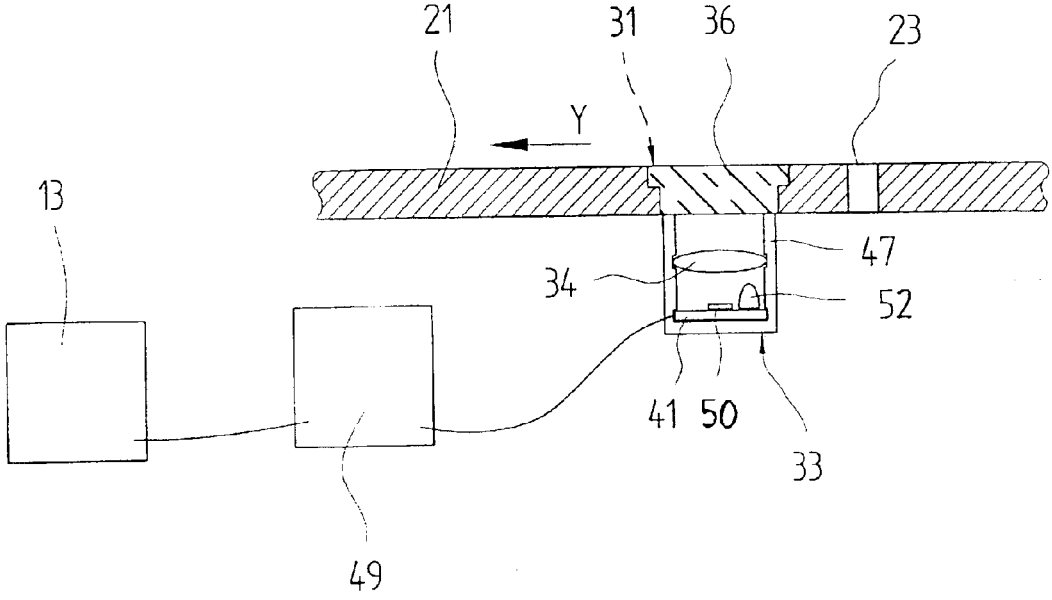
FIG. 2 is a longitudinal section view through the throat plate in the area of the position sensor.

FIG. 2 shows a longitudinal section through the throat plate 21 in the sewing direction y in the area of the position sensor 33. The protective window 36 is made of a material such as a scratchproof sapphire glass or a hard, transparent plastic. By the flush fitting the window into the sensor opening 31, the accumulation of dust or dirt particles is prevented. The lense 34 and a substrate 41 located underneath it, such as a conductor board used as a carrier of a two-dimensional CCD matrix 50 and a light source 52, such as an LED, are contained in a sensor housing 47. The position sensor 33, in particular the substrate 41 with the CCD matrix 50 and the light source 52, are connected with an electronic sensor 49 which can contain a processor with a clock rate of more than 10 MHz, for instance, and which can execute digital image processing algorithms.

Alternatively, the CCD matrix 50 and the electronic sensor 49 and, in another embodiment, the LED as well, can be integrated into a common semiconductor substrate. This is then held either on the substrate 41 or directly by the sensor housing 47. In other embodiments, the LED can also be situated on the side of the lense 34 opposite the CCD matrix or outside of the position sensor 33.

Figures 7, 8:
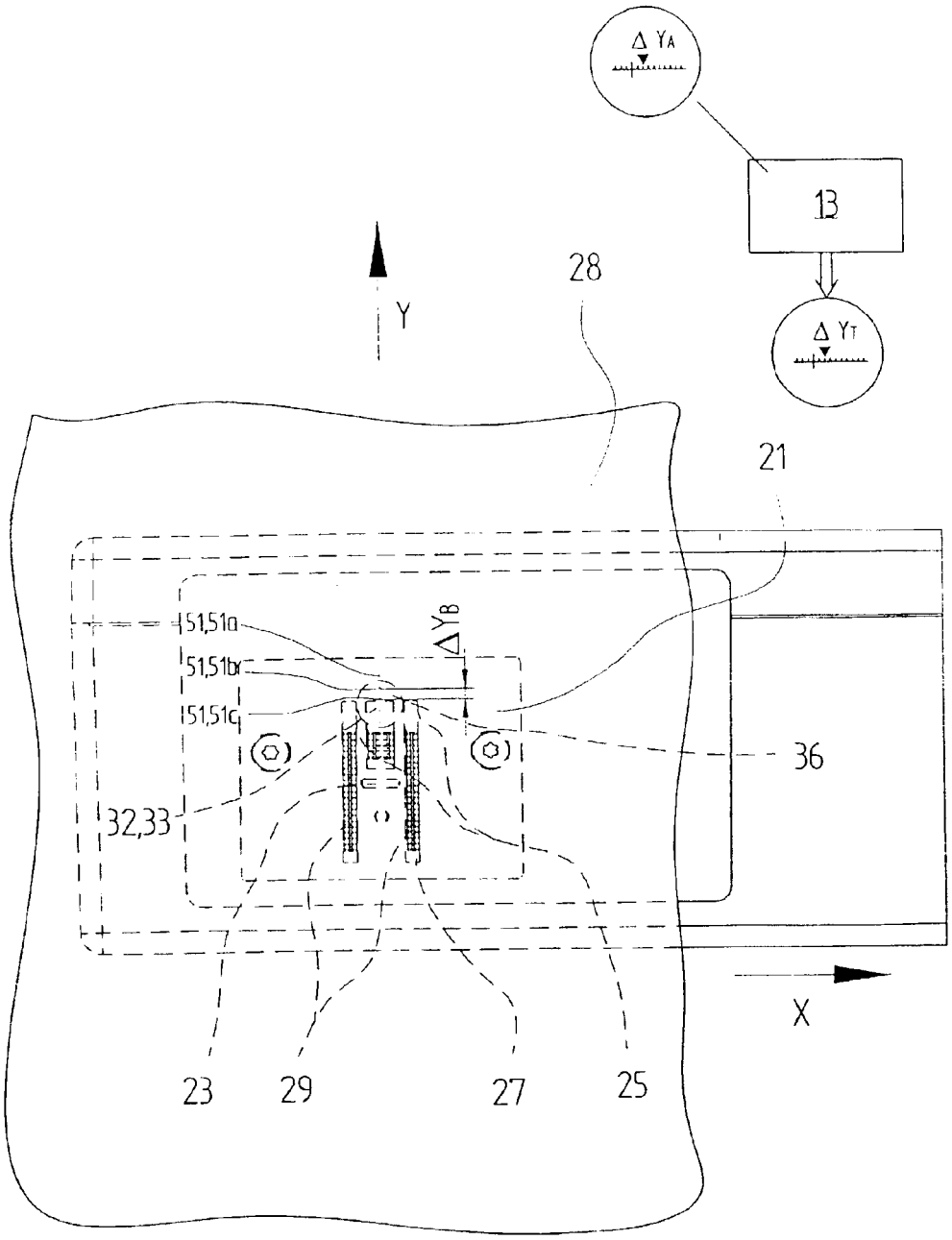
FIG. 7 is a view of the throat plate with the article to be sewn lying on it during a sewing operation in the direction of sewing.
FIG. 8 is a schematic portrayal of a calculation by the controls 13 of the size of the feeding increment $\Delta y_T$.

In FIG. 7, a view of the throat plate 21 is portrayed in which the article to be sewn 28 lies on the throat plate during the sewing process in the sewing direction y. The stitching increment or the distance of the stitch sites 51 from the already executed sewing stitches in the article to be sewn 28 is, in the example portrayed in FIG. 7, similar to a first actual increment $\Delta y_B$ of the material feeding through the material feeder 29 in the sewing direction y per feed cycle, since after each material feed cycle, a sewing stitch was executed. Basically, before the execution of sewing stitches, several material feeding cycles can be executed in which the actual material feed and/or the first actual increment in the sewing direction y each amounts to $\Delta y_B$. It is also possible that the first actual increment $\Delta y_B$ of the material feed in sewing direction y can be changed during the sewing process by the user of the sewing machine 1 or by the controls 13. In that embodiment of the sewing machine 1 which allows a material feed in both the direction of and the direction opposite the sewing direction y, the first target increments $\Delta y_A$ and the first actual increments $\Delta y_B$ can assume positive as well as negative values. In FIG. 8, the entry or specification at the controls 13 of a specified value or a first actual increment $\Delta y_A$ for the material feed in the sewing direction y is symbolically portrayed. Such a specified value can be entered, for example, by a user of the sewing machine 1 by means of a dial or a by a menu on a touch screen.

Alternatively, or in addition, the controls 13 can also calculate such specified values for first target increments $\Delta y_A$, especially in consideration of user input. The symbolically portrayed first feed increments $\Delta y_T$ in FIG. 8 likewise correspond to the pushing movement of the material transport device 27, in particular the material feed 29, operating on the article to be sewn 28 in sewing direction y. The first feed increment $\Delta y_T$ can take on a negative or positive value, depending on whether a movement backwards or forwards in sewing direction y is executed. In the ideal case, these values correspond to the first feed increment $\Delta y_T$, and the first actual increment $\Delta y_B$ corresponds to the value of the first target increment $\Delta y_A$. In reality, the first feed increment $\Delta y_T$ is, however, somewhat larger than the first target increment $\Delta y_A$, because during each transport step, a certain slippage of the article to be sewn 28 must be reckoned with. The result of this, with an average sewing material 28, is that the first actual increment $\Delta y_B$ corresponds approximately to the value of the first target increment $\Delta y_A$. For this purpose, a value for the optimal relation to the first feed increment $\Delta y_T$ for the first target increment $\Delta y_A$ for the average sewing material 28 can be stored in a permanent memory of the controls 13, for instance, whereby when this average sewing material 28 is pushed forward with this first feed increment $\Delta y_T$, an actual material feed of a first actual increment $\Delta y_B$ is achieved which corresponds to the value of the first target increment $\Delta y_A$.

In another embodiment of the sewing machine 1, the material transport device 27 is constructed in such a way that the sewing material 28 can also be moved, in addition to the sewing direction y, in the cross direction x, which is oriented perpendicularly to the sewing direction y within the sewing plane N.

Figure 9:
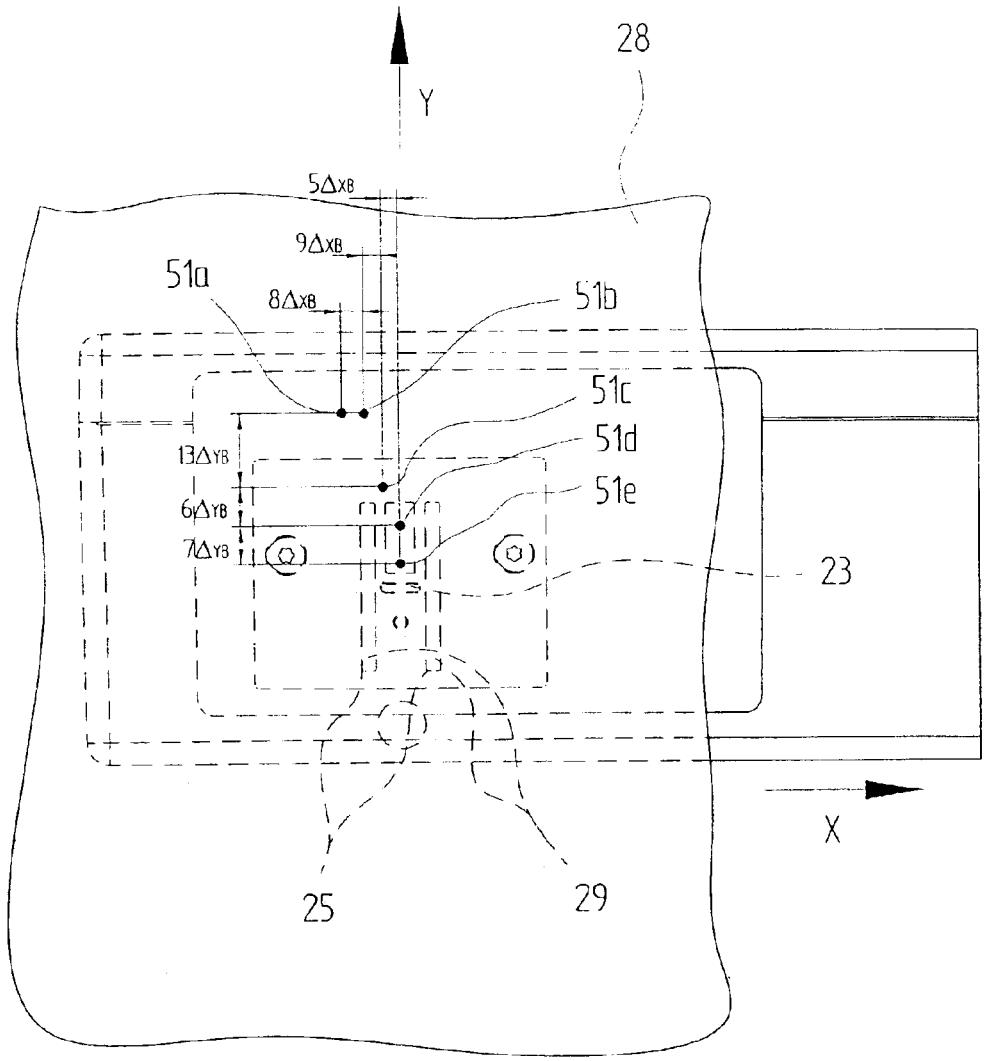
FIG. 9 is a view of the throat plate with the article to be sewn lying on it during the sewing or embroidering operation in the direction of sewing and in the cross direction.

In FIG. 9, a view of the throat plate 21 is shown in which the sewing material 28 is lying on the throat plate during the sewing operation, with feeding movements in the sewing direction y and in the cross direction x. In a manner analogous to the transport movement in the sewing direction y, the material feed 29 can also execute a transport movement in the cross direction x. In doing so, the material feeders 29 each execute a transport or feed cycle on the basis of a second target increment $\Delta x_A$ with a second feed increment $\Delta x_T$ in the cross direction x.

Figure 10:
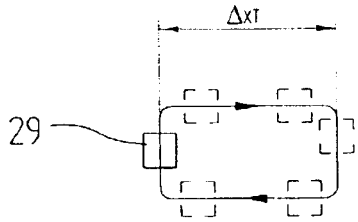
FIG. 10 is a schematic portrayal of the cyclical motion sequence of a material feeding device with a size of the feeding increment $\Delta y_T$ in the cross direction.

In FIG. 10, the cyclical movement of a bar of the presser foot 29 for such a transport cycle is portrayed. For ease of explanation, the second feed increment $\Delta x_T$ is portrayed longer than they actually are, and the dimensions of the bars are portrayed smaller than they actually are in relation to the lifting movement. Possible positions of the bars during a transport cycle are drawn in as points.

The article to be sewn 28 is moved in each case by a second actual increment $\Delta x_B$ in the cross direction. Of course, $\Delta x_A$, $\Delta x_T$, and $\Delta x_B$ can take on both positive and negative values, which correspond to movements in and opposite to the cross direction x. As can be seen in FIG. 9, the relative coordinates in units of the respective first actual increments $\Delta y_B$ in the sewing direction y and the respective second actual increments $\Delta x_B$ in the cross direction are indicated between the individual, already executed stitching sites 51*a*–51*e*. The pertinent individual feeding cycles of the material feeder 29 in sewing direction y and in cross direction x can be executed consecutively one after the other. Alternatively, a part of the feeding cycles executed between two stitching sites 51 can also be executed as a combined simultaneous movement in sewing direction y and cross direction x.

If, as illustrated in FIG. 6, an embroidery module 35 is attached to the sewing machine 1, then the transport of the article to be sewn 28 no longer takes place by means of the material feeder 29, but rather by the stepper motors through the movement device 39. In this case, the first feed increment $\Delta y_T$ has the minimum value of the increment of the step motor operating in sewing direction y. Analogously, the second feed increment $\Delta x_T$ has the minimum value of the increment of the step motor operating in the cross direction x. If these increments are very small, under 0.1 mm for example, a multiple of these increments can also be defined as the first feed increment $\Delta y_T$ and/or as the second feed increment $\Delta x_T$, in a permanent memory of the controls 13 or of the embroidery module 35, for example. Alternatively, the first feed increments $\Delta y_T$ and/or the second feed increments $\Delta x_T$ can also be redefined for each new sewing stitch, as values for the stitch length in sewing direction y and in cross direction x, for example.

With both the transport of the article to be sewn 28 by material feeders 29 and with transport by the movement device 39 for an embroidery module 35, the actual increments $\Delta y_B$, $\Delta x_B$ may deviate from the respective target increments $\Delta y_A$, $\Delta x_A$. The reason for this can be, for example, the different transport characteristics which are dependent on the article to be sewn 28, the sewing position within the article to be sewn 28 or the transport direction. Forces operating on the article to be sewn 28 during the sewing process and the results of wear on the sewing machine 1 are additional possible causes for transport characteristics which change.

Figure 11:
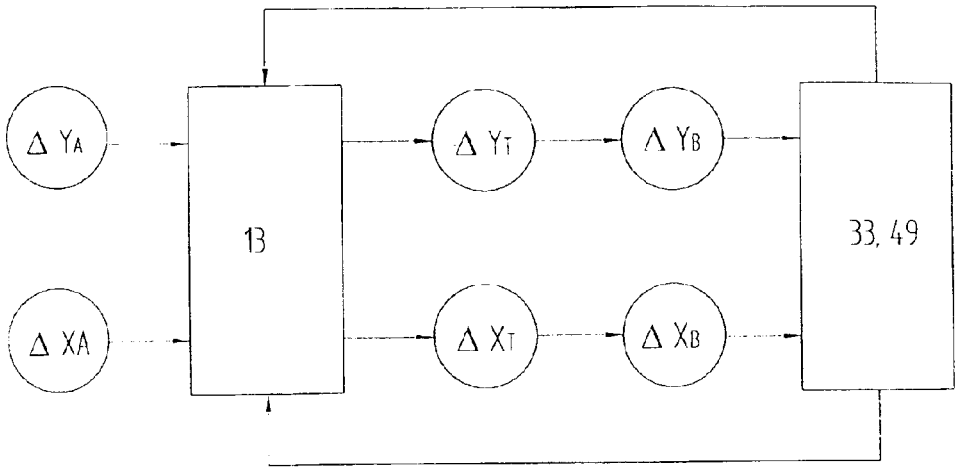
FIG. 11 is a diagram showing the principle of regulation of the sizes of feeding increments through the increments measured by the position sensors.

As can be seen from the process diagram in FIG. 11, the first feed increment $\Delta y_T$ and/or the second feed increment $\Delta x_T$ is regulated in dependence on the first actual increment $\Delta x_B$ of the actual material feed in sewing direction y and/or the second actual increment $\Delta x_B$ in cross direction x detected by the position sensor 33. An area of the article to be sewn 28 lying over the protective window 36 (FIG. 2), which has the measurements of 5 mm×5 mm, for example, is illuminated by the light source 52 and reproduced by the lense 34 on the CCD matrix 50. In connection with the electronic sensor 49, which is comprised of a digital image processing system, called IPS for short, or DSP (Digital Signal Processor), the position sensor 33 can detect and process 1500 images per second, for example. The position sensor 33 is in the position to recognize the smallest structures or differences in structures as well as their position in the detected display details by means of differences in intensity within the detected display details. On the basis of the change in position of characteristic irregularities in the surface structure of the article to be sewn 28 and/or on the basis of the change in position of color patterns of the article to be sewn 28 in consecutive and/or additional chronologically consecutive image exposures, the IPS of the position sensor 33 calculates relative displacements of the article to be sewn 28 in the sewing direction y and in the cross direction x and/or the corresponding feeding speeds. By considering several image exposures with at least one common structural characteristic, the resolution and accuracy of the position sensor 33 can be further improved. Preferably, the displacements or changes in position of the article to be sewn 28 are added up by the electronic sensor 49, based on the x and y coordinates of a zero or starting value at the beginning of the sewing process, and made available as absolute x and y coordinates for the position values in relation to the starting value in the form of an output signal.

If the article to be sewn 28 is stationary following the execution of sewing stitches or feed cycles, the controls 13 reads each of the actual feed values of the article to be sewn 28 in the x and y direction calculated by the IPS in relation to the starting value and saves them in a memory of the controls 13. Alternatively, if the sensor 32 possesses a sufficiently high clock rate, the feed value can also be transferred to the controls 13 during the material feed and be stored periodically, for example, in chronologically similar or changing intervals. As a result, a sewing step characterized by two consecutive needle stitches can be analyzed in any desired manner as individual target increments, for which then the actually executed increments are calculated by the sensor 32.

By subtraction of immediately consecutively stored corresponding values, the controls 13 calculate the actual pertinent material feed, thus the first actual increment $\Delta y_B$ and/or the second actual increment $\Delta x_B$.

Alternatively, the zero or starting value for each sewing step or feed cycle or a multiple of these can always be redefined again. In this case, the value transferred by the IPS to the controls 13 is directly the first actual increment $\Delta y_B$ and/or the second actual increment $\Delta x_B$, and the subtraction does not apply.

The controls 13 now calculate the deviation of the respective first target increment $\Delta y_A$ from the calculated first actual increment $\Delta y_B$ and store this value as the first correction value $D_y$. The first feeding increment $\Delta y_T$ is increased for the following sewing step or feeding cycle by the double of the first correction value $D_y$, thus $\Delta y_{T[2]}:=\Delta y_{T[2]}+2D_y$. With this, the calculated deviation is compensated for in only one sewing step. Finally, the value of the feeding increment $\Delta y_T$ is reduced again for the following sewing step by $D_y$, thus $\Delta y_{T[3]}:=\Delta y_{T[2]}-D_y$, and remains at this corrected value for further sewing steps until a deviation between the actual and target values is once again detected. In an analogous fashion, the regulation of the second feeding increment $\Delta x_T$ takes place.

With the regulation algorithm described, the controls 13 can correct recognized deviations with the first feeding increment $\Delta y_T$ and/or the second feeding increment $\Delta x_T$ very quickly within only one feeding or sewing step. Especially with the transport device 27 dependent on the main drive for the needle bar 15, the individual target increments within a sewing step can be arbitrarily defined, so that a regulation of the feeding increments $\Delta y_T$, $\Delta x_T$ can take place even within a single sewing step.

Alternatively, other known regulation algorithms can also be used for regulating the feeding increments $\Delta y_T$, $\Delta x_T$, in which an adjustment and a correction of errors takes place over the course of several feeding or sewing steps. By this, larger differences between the stitch lengths of two consecutive sewing stitches as well as undesired back coupling or oscillation of the sewing needle can be avoided. The calibration or regulation of the feeding increments $\Delta y_T$, $\Delta x_T$ takes place by means of step motors. With the transport devices 27 with material feeders 29, the stepper motors operate directly or indirectly on a (not illustrated) regulator for adjusting the respective feeding increments $\Delta y_T$, $\Delta x_T$. With transport devices 27 operated by stepper motors like those used in embroidery modules 35, the feeding increments $\Delta y_T$, $\Delta x_T$ of these stepper motors are directly adjusted. The sensor 32 can also be used for the optical recognition of embroidery frames if an edge is positioned over the sensor 32.

What is claimed is:

1. Method for regulating the transport of material in a sewing or embroidery machine (1), comprising providing at least one material transport device (27) for transporting an article to be sewn (28) in at least one direction for, in each case, one target increment ($\Delta y_A$; $\Delta x_A$), whereby the target increment ($\Delta y_A$; $\Delta x_A$) can be adjusted or calculated by controls (13) and influences at least one feeding increment ($\Delta y_T$; $\Delta x_T$) of the material transport device (27) for transporting the article to be sewn (28), detecting at least one actual increment ($\Delta y_B$; $\Delta x_B$) of movement of the article to be sewn by at least one sensor 32, and regulating the feeding increment ($\Delta y_T$; $\Delta x_T$) with the controls (13) depending on the actual increments ($\Delta y_B$; $\Delta x_B$) detected by the sensor (32) so that the deviations of the actual increments ($\Delta y_B$; $\Delta x_B$) from the respective target increments ($\Delta y_A$; $\Delta x_A$) are compensated for by averaging over one or several consecutive sewing steps.

2. Method for regulating the transport of material in a sewing or embroidery machine (1), comprising providing at least one material transport device (27) for transporting an article to be sewn (28) in a sewing direction (y) for, in each case, a first target increment ($\Delta y_A$) and in a cross direction (x) for, in each case, a second target increment ($\Delta x_A$), and adjusting and/or calculating the first target increment ($\Delta y_A$) and the second target increment ($\Delta x_A$) by the controls (13) to influence a first feeding increment ($\Delta y_T$) and a second feeding increment ($\Delta x_T$) of the material transport device (27) for transporting the article to be sewn (28) in the sewing direction (y) and in the cross direction (x), detecting the first actual increment ($\Delta y_B$) and the second actual increment ($\Delta x_B$) by sensors (32), and regulating the first feeding increment ($\Delta y_T$) and the second feeding increment ($\Delta x_T$) with the controls (13) depending on the first actual increment ($\Delta y_B$) and the second actual increment ($\Delta x_B$) so that deviations of the first actual increments ($\Delta y_B$) and the second actual increments ($\Delta x_B$) from the respective target increments ($\Delta y_A$; $\Delta x_A$) are compensated for by averaging over one or more consecutive sewing steps or feeding cycles.

3. Method in accordance with claim 1, wherein the controls (13) read the sensor signals periodically or with a rhythm of individual or several feeding cycles or sewing steps as data and calculates the first actual increment ($\Delta y_B$) and/or the second actual increment ($\Delta x_B$) and/or the corresponding feeding speeds.

4. Method in accordance with claim 3, wherein the first actual increments ($\Delta y_B$) and/or the second actual increments ($\Delta x_B$) and/or deviations of the actual increments ($\Delta y_B$; $\Delta x_B$) from the respective target increments ($\Delta y_{TA}$; $\Delta x_A$) detected by the sensor(s) (32) are added up or stored in a memory.

5. Method in accordance with claim 1, wherein incidental or system-dependent deviations of the first actual increment ($\Delta y_B$) and/or the second actual increment ($\Delta x_B$) from the respective target increments ($\Delta y_A$; $\Delta x_A$) detected by the at least one sensor (32) are compensated for over the course of one or more sewing steps or feeding cycles by alteration or regulation of pertinent feeding increments ($\Delta y_T$; $\Delta x_T$) in such a way that the deviations are cancelled out through averaging over the course of one or several sewing steps or feeding cycles.

6. A device for performing the method in accordance with claim 1, comprising at least one sensor (32) for detecting a measurement category in at least one spatial dimension built onto a sewing or embroidery machine.

7. A device in accordance with claim 6, wherein the at least one sensor (32) includes a CCD line scanner arranged parallel to the sewing direction (y), a CCD matrix (50), or a microcamera with an image processing system for detecting and processing a one- or two-dimensional image area.

8. A device in accordance with claim 6, wherein the at least one sensor (32) or a means for signal transmission connected to the sensor is located at least partially in a well (19) underneath a throat plate (21) of the sewing or embroidery machine (1).

9. A device for regulating the transport of material in a sewing or embroidery machine (1), comprising:

at least one material transport device (27) for transporting an article to be sewn (28) in at least one direction for a target increment ($\Delta y_A$; $\Delta x_A$);

controls (13) for adjusting or calculating the target increment ($\Delta y_A$; $\Delta x_A$) and influencing at least one feeding increment ($\Delta y_T$; $\Delta x_T$) of the material transport device (27) for transporting the article to be sewn (28);

at least one sensor (32) capable of detecting a measurement category in at least one spatial dimension for detecting at least one actual increment ($\Delta y_B$; $\Delta x_B$); and a sensor opening (33) embedded in an area of a needle opening (23) in a throat plate (21) of the sewing or embroidery machine (1), the sensor opening (33) being covered by a protective window (36), and at least one of the sensor (32) and a device for transferring a signal to the sensor (32) is located at least partially underneath the protective window (36);

wherein the controls (13) are configured to regulate the feeding increment ($\Delta y_T$; $\Delta x_T$) depending on the actual increments ($\Delta y_B$; $\Delta x_B$) detected by the sensor (32) so that the deviations of the actual increments ($\Delta y_B$; $\Delta x_B$) from the respective target increments ($\Delta y_A$; $\Delta x_A$) are compensated for by averaging over one or several consecutive sewing steps.

10. A device in accordance with claim 9, wherein the article to be sewn (28) can be pressed against the throat plate (21) or the protective window (36) in the area of the protective window (36) by shoe or roller (38).

11. A device in accordance with claim 9, wherein a light source (52) is located underneath the protective window (36).

12. An apparatus for regulating the transport of material in a sewing or embroidery machine over a plurality of feeding cycles, the apparatus comprising:

a material transport device for transporting an article by moving the article at least one feeding increment during the plurality of feeding cycles;

at least one sensor for detecting at least one actual increment of the article and producing a signal corresponding to the at least one actual increment; and controls for adjusting or calculating a target increment, and for receiving the signal corresponding to the at least one actual increment and automatically adjusting the at least one feeding increment to correspond to the at least one actual increment, wherein an accumulated value of the at least one actual increment coincides with an accumulated value of the at least one target increment over one or more of the feeding cycles.

* * * * *